US010202743B2

(12) United States Patent
Triginer Boixeda et al.

(10) Patent No.: US 10,202,743 B2
(45) Date of Patent: Feb. 12, 2019

(54) TOOTH AND ADAPTOR FOR DREDGING MACHINE

(71) Applicant: METALOGENIA RESEARCH & TECHNOLOGIES S.L., Premià de Mar (ES)

(72) Inventors: Jorge Triginer Boixeda, Barcelona (ES); Joan Tuto, Fornels de la Selva (ES); Eduard Alvarez Portella, Barcelona (ES); Jordi Brufau Guinovart, Vallromanes (ES)

(73) Assignee: METALOGENIA RESEARCH & TECHNOLOGIES S.L., Premià de Mar (ES)

( * ) Notice: Subject to any disclaimer, the term of this patent is extended or adjusted under 35 U.S.C. 154(b) by 0 days.

(21) Appl. No.: 15/966,892

(22) Filed: Apr. 30, 2018

(65) Prior Publication Data

US 2018/0245318 A1 Aug. 30, 2018

Related U.S. Application Data

(62) Division of application No. 15/325,365, filed as application No. PCT/EP2015/065875 on Jul. 10, 2015, now Pat. No. 10,024,035.

(30) Foreign Application Priority Data

Jul. 11, 2014 (EP) ..... 14382271

(51) Int. Cl.
*E02F 9/28* (2006.01)
*E02F 3/92* (2006.01)

(52) U.S. Cl.
CPC ..... *E02F 9/2825* (2013.01); *E02F 3/9256* (2013.01); *E02F 9/28* (2013.01);
(Continued)

(58) Field of Classification Search
CPC ..... E02F 9/2808; E02F 9/2816; E02F 9/2858
(Continued)

(56) References Cited

U.S. PATENT DOCUMENTS 1,696,924 A 1/1929 Rorabeck
1,775,984 A 9/1930 Younie
(Continued)

FOREIGN PATENT DOCUMENTS

EP 2 058 440 A1 5/2009
ES 2 077 412 T3 11/1995
(Continued)

OTHER PUBLICATIONS

International Search Report for PCT/EP2015/065875 dated Dec. 10, 2015 [PCT/ISA/210].
(Continued)

*Primary Examiner* — Gary S Hartmann
(74) *Attorney, Agent, or Firm* — Sughrue Mion, PLLC

(57) ABSTRACT

An adaptor for attaching a tooth to the arm of a cutter head. The adaptor having a rear coupling end and a front coupling end with a main cavity. The main cavity has a first upper surface, a first lower surface and two joining side surfaces. Each side surface has a side groove with a second upper surface parallel to a second lower surface. The second upper surface is approximately parallel to a lower segment adjacent to the bottom end on the first lower surface and the second lower surface of the side grooves is approximately parallel to an upper segment adjacent to the bottom end on the first upper surface. A distance between the second upper surface and the second lower surface of each groove is smaller than a distance between the upper segment and the lower segment of the main cavity.

3 Claims, 7 Drawing Sheets

(52) U.S. Cl.
CPC ..... *E02F 9/2808* (2013.01); *E02F 9/2816* (2013.01); *E02F 9/2833* (2013.01); *E02F 9/2858* (2013.01); *E02F 9/2866* (2013.01)

(58) Field of Classification Search
USPC ..... 37/450, 452, 454, 455
See application file for complete search history.

(56) References Cited

U.S. PATENT DOCUMENTS

| | | | |
|---|---|---|---|
| 1,951,988 | A | 3/1934 | Mekeel |
| 3,349,508 | A | 10/1967 | Petersen |
| 3,606,471 | A | 9/1971 | Evans |
| 3,665,623 | A | 5/1972 | White |
| 4,329,798 | A | 5/1982 | Edwards |
| 5,074,062 | A | 12/1991 | Hahn et al. |
| 5,148,616 | A | 9/1992 | Maguina-Larco |
| 5,152,087 | A | 10/1992 | Maguina-Larco |
| 6,321,471 | B2 | 11/2001 | Fernandez Munoz et al. |
| 7,694,443 | B2 | 4/2010 | Gabela et al. |
| 10,024,035 | B2 * | 7/2018 | Triginer Boixeda ..... E02F 3/9256 |

FOREIGN PATENT DOCUMENTS

| | | | |
|---|---|---|---|
| GB | 2 010 777 | A | 7/1979 |
| WO | 2011/149344 | A1 | 12/2011 |

OTHER PUBLICATIONS

Written Opinion for PCT/EP2015/065875 dated Dec. 10, 2015 [PCT/ISA/237].

* cited by examiner

TOOTH AND ADAPTOR FOR DREDGING MACHINE

CROSS REFERENCE TO RELATED APPLICATIONS

This application is a divisional of U.S. application Ser. No. 15/325,365, filed Jan. 10, 2017, which is a National Stage of International Application No. PCT/EP2015/065875 filed Jul. 10, 2015, claiming priority based on European Patent Application No. 14382271.6 filed Jul. 11, 2014, the contents of all of which are incorporated herein by reference in their entirety.

OBJECT OF THE INVENTION

The present invention, tooth and adaptor for dredging machines, relates to a tooth or wear member which, attached to an adaptor, creates an stabilized assembly against all the forces exerted on the point of the tooth. The purpose of the tooth and the adaptor of the present invention is to dredge the seabed and deepen and clean the beds of ports, rivers, channels, etc., removing therefrom sludge, stones, sand, etc., the adaptors being attached to the arms of the cutter head of the dredging machine.

The dredging machine, or dredger, allows excavating, transporting and depositing material that is located under the water, using cutting members, teeth or adaptors on different kinds of terrains.

The tooth and adaptor object of the present invention are preferably intended to be used in dredging machines having a suctioning cutter head of the type which while at the same time it excavates the terrain under the water, the loosened material is suctioned by a pump and transported somewhere else through a pipe.

STATE OF THE ART

Systems of tooth and adaptor are known in the state of the art for their application in dredging operations. The main objective of said operations is to remove material from marine or river beds, usually made using cutter suction dredgers that include cutter head on which various teeth are arranged via adaptors.

As stated, in order to dredge underwater soil, a cutter suction dredger is used. The cutter suction dredger is a stationary dredger equipped with a cutter head that excavates the soil and afterwards said soil is suctioned up by the dredge pump or pumps.

Such cutter suction dredger is anchored to the ground by means called spud poles, and through them, the strong reaction forces occurring during dredging are absorbed and transferred to the ground. The cutter head is mounted to the cutter suction dredger through a ladder. In the known suction dredger the ladder forms a more or less rigid connection between the cutter head and the cutter suction dredger. In order to dredge underwater soil, the cutter head with ladder and suction pipe is lowered under water in a usually slanting direction, until the cutter head touches the bottom, or until it reaches the maximum depth. The movement of the dredger round the spud pole is initiated by slacking the starboard anchor cable and pulling in the port side anchor cable or reverse, so that a more or less circular soil path is formed. These anchor cables are connected via sheaves close to the cutter head to winches (dredging side winches) on deck. The paying out winch ensures the correct tension in both cables, this being particularly important when dredging in hard rock.

The cutter head is rotated relatively slowly (common rotation speeds of 20 to 40 rpm), as a result of which soil pieces are beaten off by the dredging teeth at great force. By each time moving the suction dredger over a given distance and repeating the above described ladder movement, a complete soil area can be dredged.

The cutter suction dredger can tackle almost all types of soil, although of course this depends on the installed cutting power. For heavy cutter suction dredgers the limit will be rocks with a compression strength of around 80 MPa, if the rock is weathered and has many crocks, it is possible to go a little further than that.

The cutter head is provided with wear elements that penetrate and tear up the ground. These wear elements are teeth connected to adaptors fixed to the arm of the cutter head, the teeth connected to said adaptors in a detachable way.

The cutter head works in a rotational movement, so the teeth tear up the ground forming an arched path. Depending on the direction in which the tooth starts to penetrate the ground a different cut is obtained. When the tooth starts penetrating the surface area of the ground and tears up downwards of the ground till the rotation movement leaves the ground, an over-cutting is obtained. On the other hand, when the tooth starts to tear up from inside the ground and tears up upwards till the surface area of the ground, an under-cutting is obtained.

When the teeth tear up the ground in over-cutting and under-cutting, reaction forces appear on the point of the teeth. All reaction forces from the cutter head have to be transferred in a certain way to the surroundings, either by the side winch forces or the spud poles to the soil, or via the ladder wires and the pontoon to water. Besides that, these cutting forces determine the weight of the dredger, while the forces to move the dredger through the water can have influences on the design of the dredging parts.

Cutter heads have seldom a cylindrical shape but rather have profiles with parabolic shape. This profile is determined by a plane through the surface of revolution formed by the tooth points. The cutter head is composed by arms in which the teeth are attached. The teeth are normally positioned in such a way that the projection of it's center line is normal to the profile. An imaginary line from the center line of the cutter head to the point of the tooth is created, normal to said profile.

The active point of the tooth is provided with three surfaces, a working surface which is the surface that has direct contact with the ground, an opposite surface which is opposite to the working surface and a normal surface that separates the working surface and the opposite surface.

As such, three reaction forces appear on the point of the teeth

- Normal force or radial force ($F_N$): in a same direction of the imaginary line between the center line of the cutter head and point of the tooth, applied on a normal surface of the tooth.
- Tangential force ($F_T$): perpendicular to the normal force and applied on the working surface of the tooth. This tangential force is in direction parallel to the ground.
- Lateral force: Mainly caused by the interaction of neighboring cuts.

During the overcutting, the ladder will tend to move upwards when the tooth impacts against the surface area of the ground when it starts to penetrate the surface area of the ground. These impacts are larger when the hardness of the soil and the layer thickness are also harder.

Water conditions also affect the dredging development and the dropping of the production ratio. With certain types of waves, the ship will start moving; therefore the cutter head will move up and down because of the vertical movement of the waves and this provokes undesired hits of the cutter head and above all the teeth over the ground, causing a cut that is either too deep or too shallow.

Furthermore, in hard soil the cutting force is a decisive factor, therefore a heavy load on the construction of the ladder and on the spud, in particular, is added to facilitate the dredge work.

When said undesired vertical movement of the ladder appears due to the overcutting, water conditions and an overweight of the cutter for hard soil, the cutter teeth are loaded over the opposite surface with a wrong direction causing an important damage to the teeth, to the adaptors and to the pin system. In certain conditions the dredging process has to be stopped. An unexpected inverse force ($F_1$) appears on the opposite surface of the cutter tooth.

When these unexpected inverse forces ($F_1$) appear during work, which are worst when working on hard soil, the tooth moves/rotates due to the effects of said forces on the point of the tooth and when the coupling is not correctly stabilized which makes unstable the coupling between the tooth and the adaptor, that causes the unbalanced movement between the contact surfaces of the tooth and the adaptor. This situation makes the stability of the system worse and in some occasions it can even cause the breakage of the pin. The fact that a system is not correctly stabilized makes that the efforts from the tooth to the adaptor, and therefore from the adaptor to the arm of the cutter head, are transmitted in an incorrect way. The efforts are always withstood by the contact surfaces between the tooth and the adaptor, but when the coupling is not stabilized and a secure and uniform contact between the surfaces is not achieved, the efforts are transmitted to the pin too. The consequence of this instability is that the movement between the tooth and the adaptor increases and accordingly the gap between them increases too. At the same time a non-desired wearing on the contact surfaces between the tooth and the adaptor also gets worse. This happens because the inverse forces are not compensated by the reactions between the contact surfaces of the tooth and the adaptor.

When the tooth tries to move in the direction of the inverse force there is no contact surface on the adaptor and the tooth to prevent said movement and therefore the efforts can get to the pin that is the one that supports the same. As the pin is not designed to support said efforts the same usually deforms or breaks. If the same deforms it will be difficult to extract the pin from its housing when the tooth has to be replaced, and if it breaks the tooth can fall and the adaptor is damaged due to impacts and wearing.

Therefore, it is important that the tooth and adaptor have contact surfaces that counteract all the forces that can be exerted on different places of the wear part of the tooth, so that all the possible contacts between the tooth and the adaptor are balanced.

In the state of the art there are different teeth for dredge working but none of them are really prepared to resist in an effective way the inverse forces exerted on the point of the tooth without the breakage of the pin, tooth or even the adaptor.

The closest prior art is EP2058440 that describes a tooth with a rear coupling part or nose for engaging to an adaptor with the assistance of a transversal pin that goes through the nose and the adaptor. The contact surfaces between the tooth and the adaptor contribute to the stabilization during work against the normal and tangential forces, but not against inverse forces, that as previously explained cause the movement of the tooth inside the cavity of the adaptor due to the lack of contact surfaces against said movements. These movements transfer the efforts to the pin, that suddenly changes it function from a retaining function to a resistance function. As the pin is not designed to resist excessive forces, the same deforms or even breaks depending of the force suffered and this turns out in the problems mentioned above, and mainly losing the tooth under the water and preventing the extraction of the pin due to its deformation in a hammerless way. In FIG. 18, the reaction forces when a tooth according to the cited prior art document is subjected to an inverse force are shown. In the figure it can be seen a reaction force at the free end of the upper surface of the nose and another reaction in the lower side of the inclined surface. The horizontal (Rx) reaction on the lower side of the inclined surface of the collar, which is not compensated by other reaction, tends the tooth to go out (to be ejected) of the system and therefore making the contact area and, above all, the pin suffer excessive forces as previously described. The forces ($F_1$) applied on the point of the tooth make the tooth rotate in respect of the adaptor, as the upper surface of the free end of the nose and the lower surface of the inclined surface of the collar of the tooth contact with the adaptor, causing the mentions reactions. As stated the reaction Rx is the one that tends to eject the tooth from the coupling, and is the one that the present invention counteracts.

U.S. Pat. No. 3,349,508 refers to a replaceable tooth for earth digging equipment. A feature of the invention is the shape of the proximal portion of the tooth which is received in the tooth holder and the cooperating shape of the recess or-socket of the tooth holder which is complementary thereto. In cross section, the portion of the tooth received in the holder is T-shaped, with side projections with upper and lower surfaces and a lower segment adjacent to the rear free end of the portion of the tooth received in the holder.

U.S. Pat. No. 7,694,443B2 and WO2011149344 describe teeth for dredge working where the tooth is fastened to the adaptor through a retention system that does not go through the tooth and the adaptor but retains the tooth through the end of the nose by pulling it against the adaptor using elastic means. This solution reduces the gaps between the tooth and the adaptor. These systems comprise at the free end of the nose of the tooth a hook that is used to exert a traction force on the tooth. This hook makes this part of the tooth the weakest one and therefore is subjected to breakage because there are traction reactions confronted between the tooth and the adaptor. Said elastic means in the retention system to maintain the tooth and the adaptor in contact due to the traction force exerted do not prevent the appearance sometimes of gaps between the contact surfaces. When these gaps appear the system is not well stabilized and the tooth and adaptor can move one in respect of the other because they do not have good contacts between both elements. The invention object of the present application prevent the formation of gaps due to the stabilization between the contact surfaces.

Spanish patent document number ES-2077412-A describes an asymmetric tooth and adaptor assembly made up of three parts requiring the use of two fastening systems. The fact that it has three parts complicates the entire system because it requires a larger number of spare parts and three fastening systems, one of which requires the use of a hammer whereas the other two fastening systems are formed by welding, making the tasks for replacing them long and complex. Further, the pin is placed on a side of the nose of the tooth, on a slot, making the system asymmetric and therefore providing a system less stable against the forces exerted on the tip of the tooth, specifically only stabilized on one side. The grooves in the nose of the tooth makes the system less resistant too because the section of the nose is smaller where the grooves are placed.

The present invention solves the drawbacks of the solutions existing in the state of the art for dredging machines, and among others:

- Great stability of the coupling between the adaptor and the tooth to prevent the action of the inverse forces, contributing to an optimal distribution of the reaction forces along the contact surfaces between the tooth and the adaptor to prevent the tooth from moving on the adaptor.
- Minimize or remove reaction forces on the assembly that tend to extract the tooth from the adaptor
- Protect the pin connecting the adaptor and the tooth, from deformation and breakage due to said stabilization.
- Reduce the material needed for the pin, as the efforts resisted by the pin are diminished. This reduction of material turns in a reduction of the diameter of the pin and therefore in a reduction of the diameter in the holes of the housing for said pin in the tooth and the adaptor. The coupling parts in the tooth and the adaptor of the present solution are more robust than the state of the art ones.

DESCRIPTION OF THE INVENTION

The invention describes a tooth with a front wear part and a symmetric rear coupling part, respect a vertical plane ZY, intended for being housed within a cavity arranged in the body of an adaptor, object too of the present invention, and an assembly formed by both for dredging machines, both parts being attached to one another by means of a preferably hammerless, preferably vertical-type locking system. The adaptor is attached to the arm of the cutter head of the dredging machine at the end opposite to the cavity by means of a coupling adapted for such purpose.

According to the above, the vertical plane ZY is defined by the z axis and the y axis. The z axis extends longitudinally along the body of the rear coupling part of the tooth and the cavity of the adaptor. The y axis is orthogonal to axis z and extends vertically. The x axis is orthogonal to the previous defined axis z and y.

The main purpose of the present invention is to support or resist the previously described inverse forces that appear on the point of the teeth during dredging works at the same that the other reaction forces due to the normal and tangential forces, as well as the lateral or side forces, on the tooth are minimized.

A first object of the invention is to provide a tooth which enables coupling to the cutter head of a cutter suction dredger, via an adaptor, which presents a complete stabilized coupling, including the stabilization against inverse forces. Said first object is achieved by a tooth according to claim 1.

A second object of the invention is to provide an adaptor which enables coupling of a tooth to a cutter head of a cutter suction dredger, which presents a complete stabilized coupling, including the stabilization against inverse forces.

A third object of the invention is a coupling system or a tooth and adaptor assembly made up by a tooth and adaptor according to the previous claims.

In a first aspect, the invention relates to a tooth for coupling to the cutter head of a cutter suction dredger, via an adaptor, the tooth having a front wear part and a symmetric rear coupling part, respect a vertical plane ZY. The rear coupling part has a main body with a rear free end and a forward end that is bounded to the front wear part, having the main body a first upper surface and a first lower surface joined by two side surfaces. Adjacent to the rear free end of the first upper surface there is an upper segment that extends a certain distance from said rear free end towards the forwards end. A lower segment, approximately parallel to the upper segment, is provided too on the first lower surface.

Each side surface of the main body defines a side projection with a second upper surface that is parallel to a second lower surface, being said second upper surface approximately parallel to the lower segment on the first lower surface of the main body and the second lower surface approximately parallel to the upper segment on the first upper surface. The parallelism between said surfaces is important to counteract the forces exerted on the tip of the wear part of the tooth. The wider the projections are the better for counterbalancing the reactions on the contact surfaces, but this dimension depends on the geometry of the coupling between the tooth and the adaptor. The distance between the second upper surface and the second lower surface of the projections is smaller than the distance between the upper segment on the first upper surface and the lower segment on the first lower surface of the main body. The second upper surface of the projection is preferably an extension of the first upper surface, forming both surfaces one contact surface at the same level. Anyway, the first upper surface and the second upper surface could conform two different contact surfaces, therefore at different levels.

The tooth can include a centered upper rib on the first upper surface that increases the section of the rear coupling part. Said rib extends between the upper segment of the first upper surface and ends at the front wear part. Specifically, the rib starts where the upper segment ends in the direction of the forward end of the nose, and ends where the rear coupling part binds the front wear part.

The tooth can include too a stopper placed between the front wear part and the rear coupling part or nose, determining the place where both parts bind. Said stopper surrounds as a collar, perimeter projection or flange the first main body and comprises two V-shaped sides, being the distance between said two V-shaped sides larger than the distance between the side projections. The purpose of said stopper is:

- Protecting the adaptor from wear through the deflectors in the upper and lower areas and which have been designed to redirect the flow of loosened material, preventing such material from friction or hitting against the adaptor and therefore preventing the wear thereof, and
- Making contact with the adaptor after prolonged wear, being thicker to resist the larger stresses to which it is subjected when contact with the adaptor is made, determining a further contact area between the tooth and the adaptor.

Said stopper can have variable thickness along its length depending on the stresses to which it is subjected during the work of the coupling. Specifically, said stopper has the thickest areas in its upper and lower area. The upper and lower second surfaces of the projections of the coupling part of the tooth extend until they meet the V-shaped sides of the stopper, defining said union between said second surfaces and the V-shaped sides an increase of the upper rib area, Further, said union is made through curved surfaces to reinforce the union between the different surfaces.

In a second aspect, the invention relates to an adaptor for coupling or attaching a tooth to the arm of a cutter head, said adaptor having a rear coupling end to attach the adaptor to the arm of the cutter head and a symmetric front coupling end, respect a vertical plane ZY, to couple to the tooth. This front coupling has a main cavity with a bottom end and an open end, said bottom end being bounded to the rear coupling end, and having the cavity a first upper surface and a first lower surface joined by two side surfaces that determine two side walls. The geometry of the cavity of the adaptor is complementary to the geometry of the nose of the tooth to allow the coupling between both.

Each side surface or wall of the main cavity has a side groove with a second upper surface approximately parallel to a second lower surface, being said second upper surface approximately parallel to a lower segment, adjacent to the bottom end on the first lower surface of the main cavity and the second lower surface parallel to an upper segment adjacent to the bottom end on the first upper surface. The upper segment is part of the first upper surface of the cavity and the lower segment is part of the first lower surface of said cavity. The approximate parallelism between said surfaces is important for the reaction forces that appear of the same to counteract the forces exerted on the tip of the wear part of the tooth. Said grooves are preferably continuous, therefore without interruptions along its surfaces, to achieve a uniform distribution of said reaction forces along the second surfaces.

The distance between the second upper surface and the second lower surface of the grooves is smaller than the distance between the segments of first upper surface and the first lower surface of the cavity. The second upper surface of the groove is preferable at the same level of the first upper surface, but it could be too on a different level.

The two side walls of the cavity, and specifically the free end of said side walls may have, in conjunction with the shape of the tooth, a V-shape.

According to the above, the tooth defines a front wear part and a rear coupling part, or nose, intended for being housed within a cavity arranged in an adaptor. Both the tooth and adaptor, when coupled, form an assembly or coupling system for dredging machines, both members being attached to one another by means of a preferably hammerless, vertical-type retaining system. The adaptor is attached to the arm of the cutter head of the cutting suction dredger at the end opposite to the cavity by means of a coupling adapted for such purpose.

Therefore, and as previously stated, the main object of the present invention is a tooth, an adaptor and the assembly formed by both, preferably applied to dredging machinery, that due to an increased and optimized stability of the contact surfaces between the tooth and the adaptor it allows that the forces exerted on the point of the tooth, independently of its direction, are transferred to the adaptor and at the same time to the arm of the cutter head. Therefore, the efforts are moved away from the contact surfaces of the assembly, existing between the tooth and the adaptor, to liberate the same from said efforts and to prevent, as much as possible, the breakage and loosening of any of the parts.

This object of the invention is achieved due to a particular construction of the contact surfaces between both members, that resist all the forces that appear on the point or tip of the tooth, and among all the forces, it is stabilized against the inverse forces previously described.

Said stability is achieved due to the configuration of the contact surfaces, which allow a distribution of stresses that favors the resistance and reduction of the stresses to which the retaining system and the tooth is subjected. In order to improve the stability, the rear coupling part of the tooth and the front coupling end of the adaptor are symmetric to achieve a balanced distribution of the efforts.

The cutting tooth and the adaptor objects of the present invention have contact surfaces and constructive features that allow the coupling between both members to increase its performance, particularly the efficiency of each tooth, thus improving the efficiency of the dredging machine.

An assembly that is well stabilized prevents an excessive wear of the contact surfaces between the tooth and the adaptor, and therefore prevents too that the gaps between both members increase during the use of the assembly.

The tooth is made up of two different parts, a front wear part, which is the part acting on the ground and is subjected to erosion due to the terrain, and a rear coupling part or nose, which is the part that is inserted in a cavity arranged for such purpose in the adaptor, and subjected to the reactions and stresses generated by the work of the tooth on the terrain. Said rear coupling part or nose is formed by a first main body with one free end and a forward end, opposite to the free end and bounded to the front wear part. The main body has two side surfaces having each of the surfaces a side projection which has the function of resisting the inverse forces.

The adaptor is also made up of two parts, a rear coupling end to attach the adaptor to the machine, and provided with a configuration that can vary depending on the type of machinery to which it is connected, to an arm of a cutter head of a dredging machine, whereas at the opposite end or front coupling end has a cavity intended to receive the rear coupling part or nose of the tooth. The inner configuration of the surfaces of the cavity of the adaptor for receiving the tooth are complementary to that of the nose of the tooth, comprising too each side surface of the cavity a side groove for the side projection of the tooth, thus assuring a perfect coupling between both members. For the coupling between the tooth and the adaptor, both parts preferably have a hole or through borehole from the upper part to the lower part of the adaptor, traversing the nose of the tooth.

A pin preferably with surfaces of revolution and with a preferably hammerless retaining system (which does not require striking with a hammer or mallet for being inserted or removed) is used.

The assembly of the rear coupling part or nose of the tooth in the cavity of the adaptor is possible due to the conjunction of the planes defining the described contact surfaces. A resisting or crushing effect between the tooth and the adaptor is furthermore achieved by means of said contact surfaces when the forces are applied to the wear tip of the tooth in a working situation of a tooth in a cutter head of a cutter suction dredger.

Due to this stabilized contact between the surfaces of the tooth and the adaptor, the pin is subjected to fewer stresses than in conventional interlocking systems since the tooth-adaptor system absorbs the great stresses when it is subjected to unexpected direction forces on the opposite surfaces, releasing stresses into the retaining system and the tooth/adapter contact surfaces, and therefore allowing designing pins of the retaining system with a smaller size and section since they are subjected to fewer stresses. The fact of reducing the size of the pin, and specifically the diameter, allows the design of a tooth and adaptor with smaller holes (smaller diameter) to access the housing of the pin. Therefore the nose of the tooth and the adaptor can be more robust.

According to the previous description, it is important to emphasize that the first and second upper and lower surfaces, on the tooth and on the adaptor, are stabilization planes that represent contact surfaces. Said stabilization planes serve to stabilize the tearing out forces that are produced at the point of the tooth, specifically the normal, tangential and inverse forces. The purpose of said surfaces is to nullify the reactions that tend to separate the tooth from the adaptor. It is necessary to nullify the horizontal reactions of the inverse forces applied on the contact surfaces between the tooth and the adaptor and that tend to extract the tooth from the adaptor. To prevent said extraction reactions, the reactions forces on the contact surfaces must have the same direction to the force, and to achieve this objective the approximately parallel first and second upper and lower surfaces are provided.

DETAILED DESCRIPTION OF THE DRAWINGS

To complement the description being made and for the purpose of aiding to better understand the features of the invention, according to a preferred practical embodiment thereof, a set of drawings is attached as an integral part of said description which show the following with an illustrative and non-limiting character:

Figure 7:
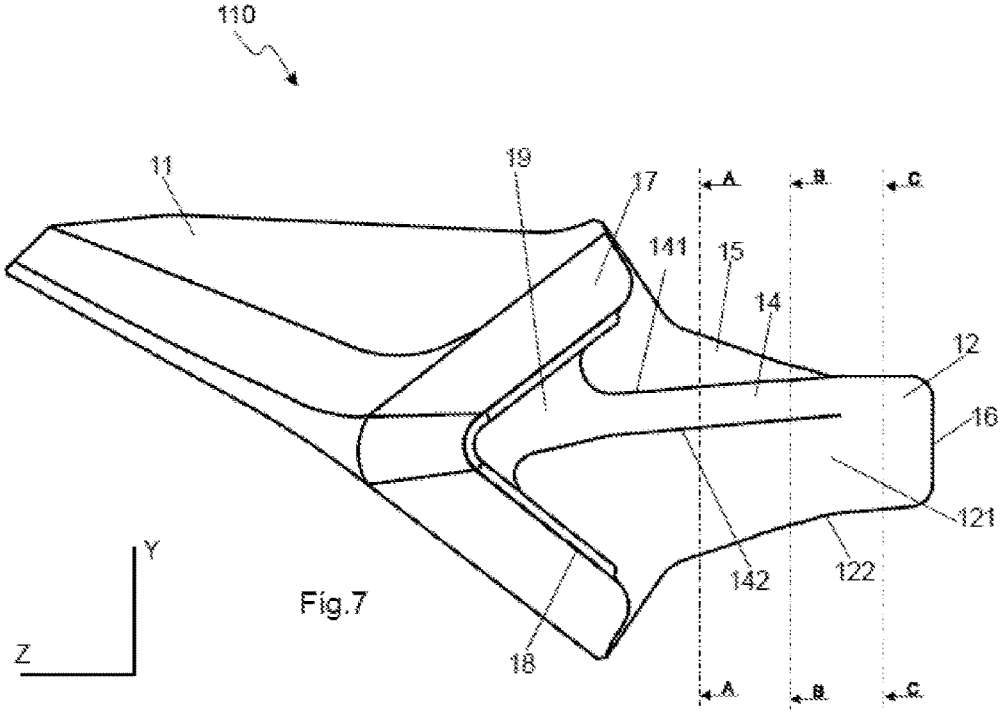
FIG. 7 shows another side view of a tooth.
Figure 8A:
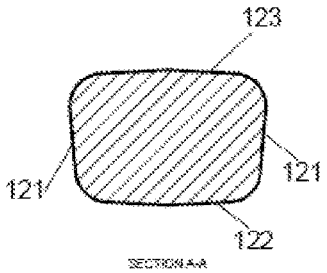

FIG. 8*a* shows a section, according to A-A, of the tooth of FIG. 7.

Figure 8B:
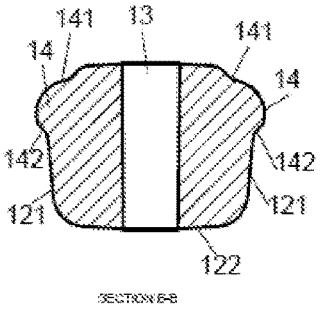

FIG. 8*b* shows a section, according to B-B, of the tooth of FIG. 7.

Figure 8C:
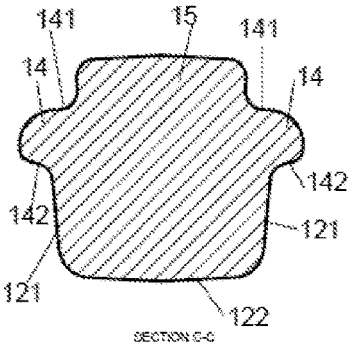

FIG. 8*c* shows a section, according to C-C, of the tooth of FIG. 7.

Figure 9:
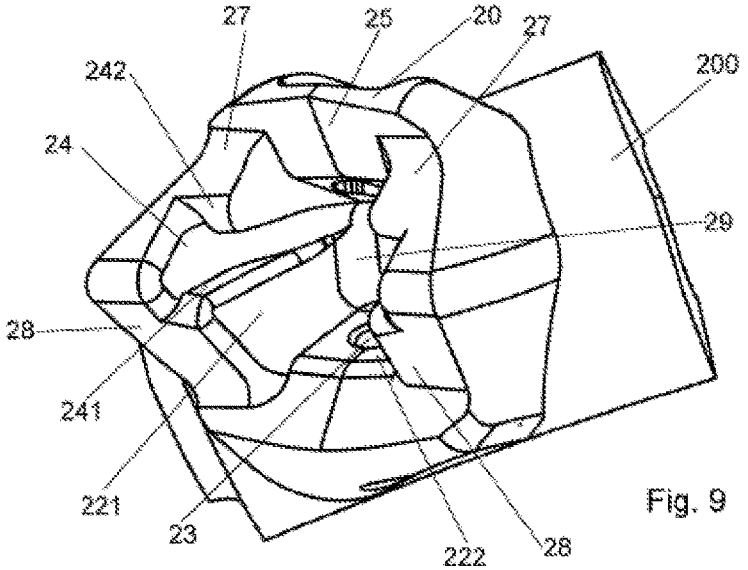

FIG. 9 shows a perspective view of an adaptor.

Figure 10:
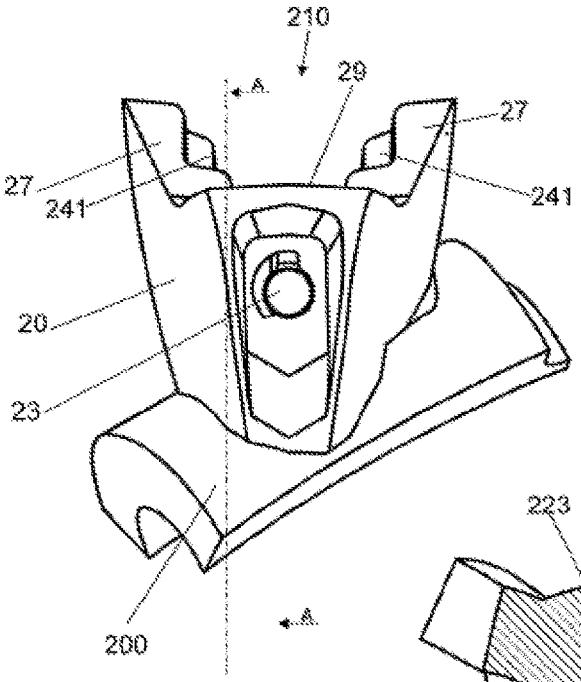

FIG. 10 shows a plan view of an adaptor.

Figure 11:
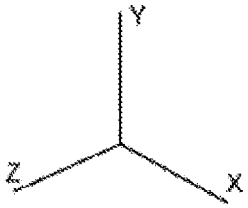
Figure 11:
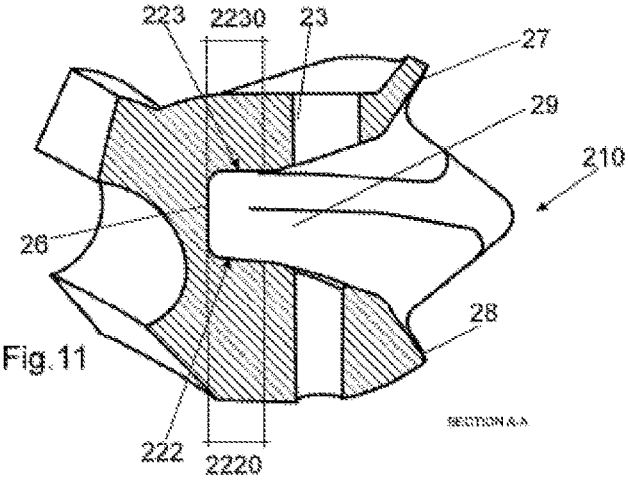

FIG. 11 shows a section, according to B-B of the adaptor of FIG. 10.

Figure 12:
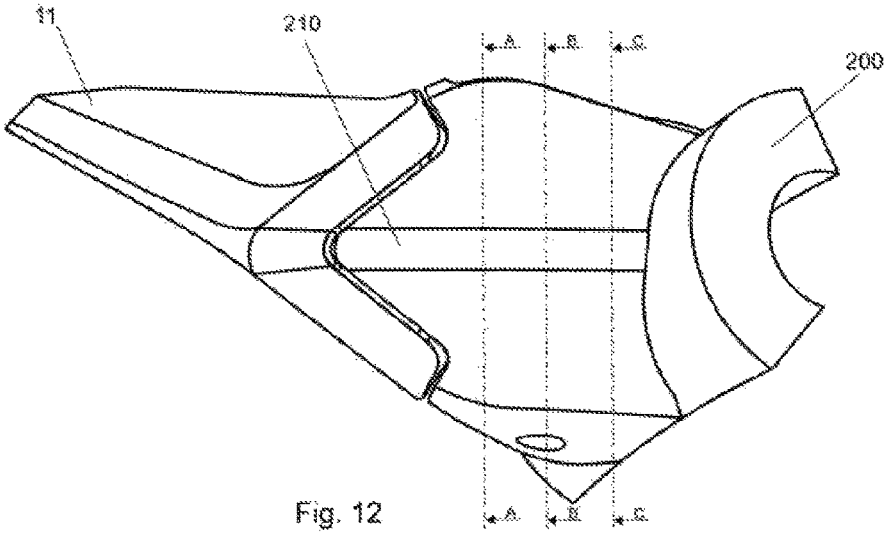

FIG. 12 shows a side view of a tooth coupled to and adaptor.

Figure 13A:
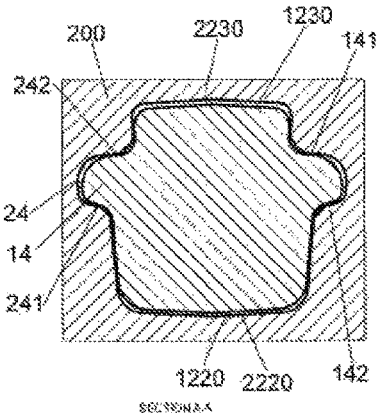

FIG. 13*a* shows a section, according to A-A, of the assembly of FIG. 12.

Figure 13B:
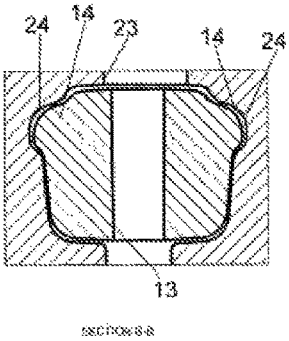

FIG. 13*b* shows a section, according to B-B, of the assembly of FIG. 12.

Figure 13C:
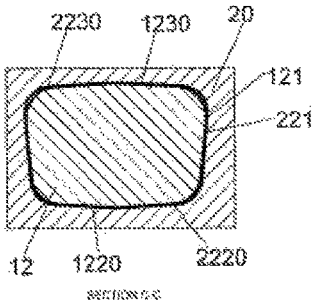

FIG. 13*c* shows a section, according to C-C, of the assembly of FIG. 12.

Figure 14:
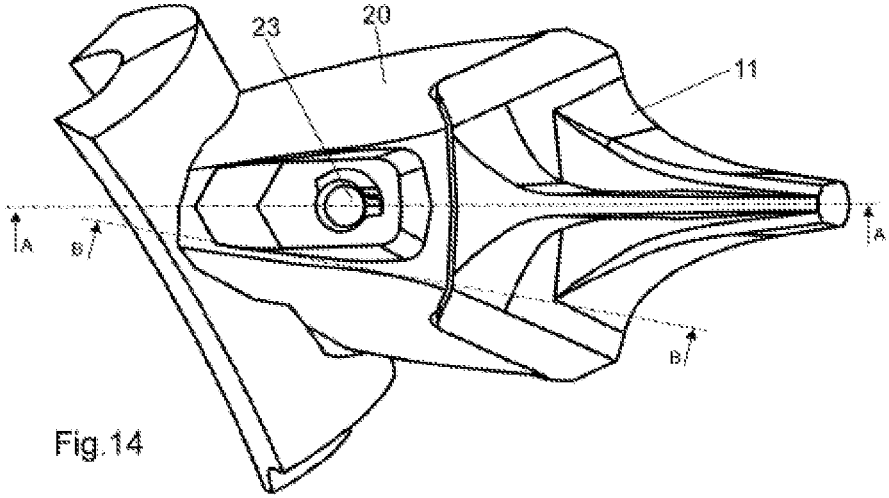

FIG. 14 shows a plan view of a tooth coupled to an adaptor.

Figure 15:
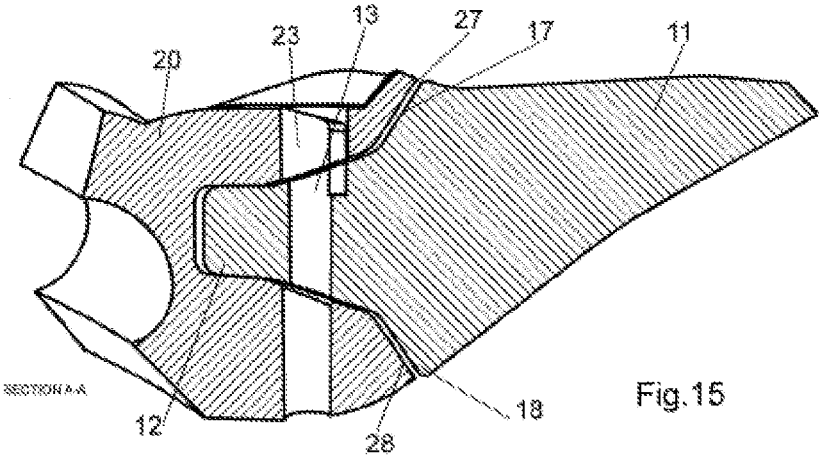

FIG. 15 shows a section, according to A-A, of the assembly of FIG. 14.

Figure 16:
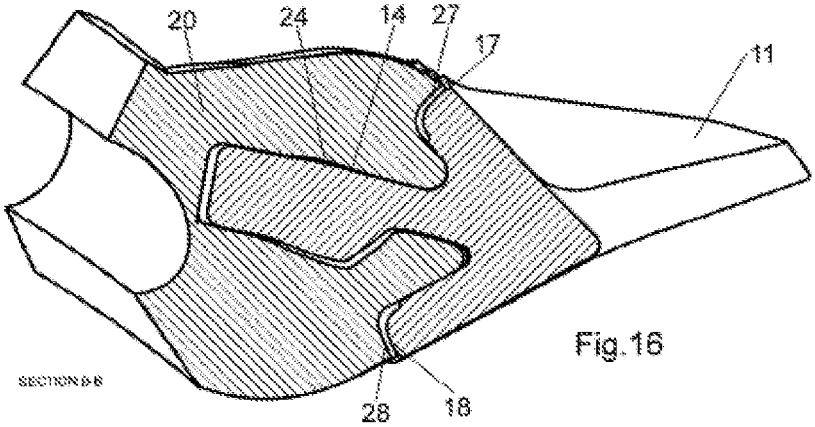

FIG. 16 shows a section, according to B-B, of the assembly of FIG. 14.

Figure 17:
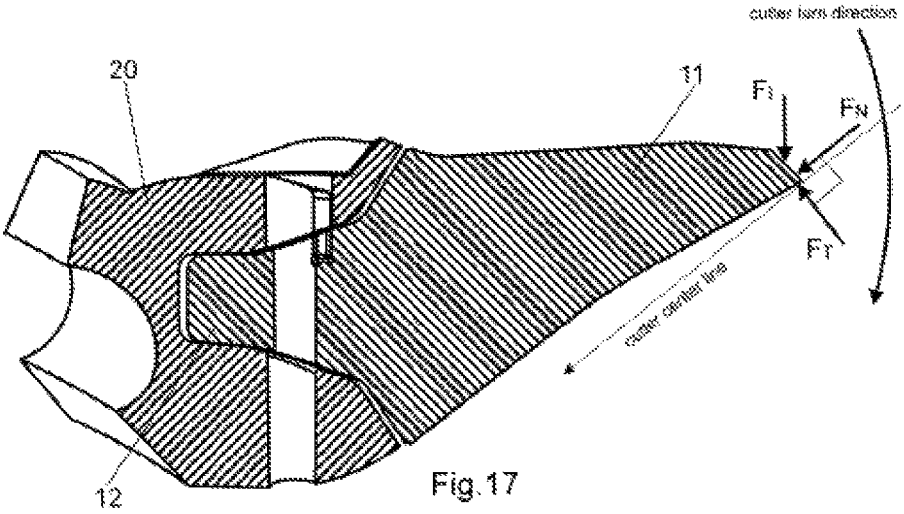

FIG. 17 shows a tooth coupled to an adaptor showing the forces (normal, FN, and positive tangential, FT) to which the assembly might be subjected during the work of the tooth in a determined cutter turn direction.

Figure 18:
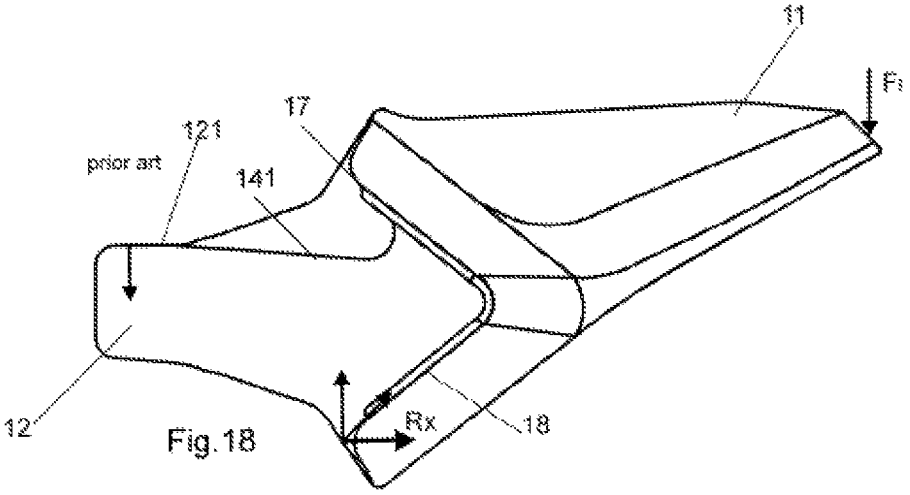

FIG. 18 shows a prior art tooth subjected to a negative tangential force (−FT) and the reactions on the tooth to said force. The reactions on the tooth to a positive tangential force (FT) are also indicated.

Figure 19:
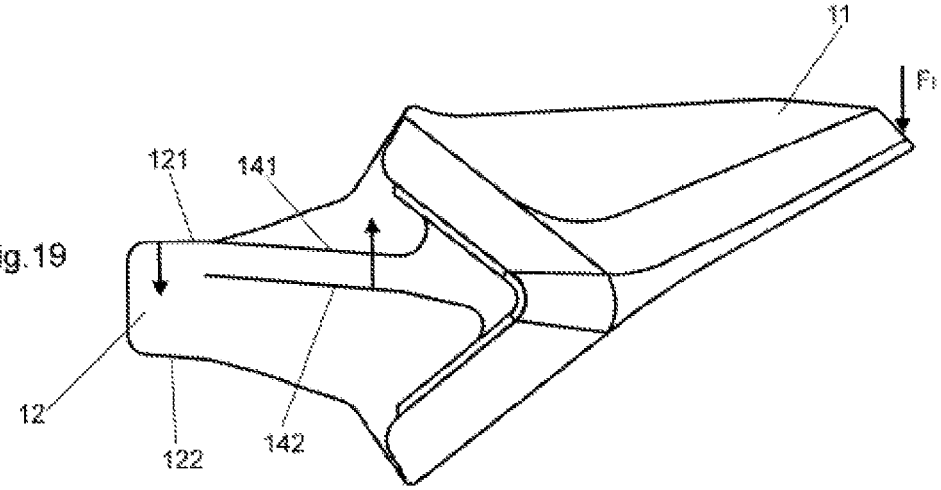

FIG. 19 shows a tooth subjected to a negative tangential force (−FT) and the reactions on the tooth to said force. The reactions on the tooth to a positive tangential force (FT) are also indicated.

DESCRIPTION OF A PREFERRED EMBODIMENT

Figure 1:
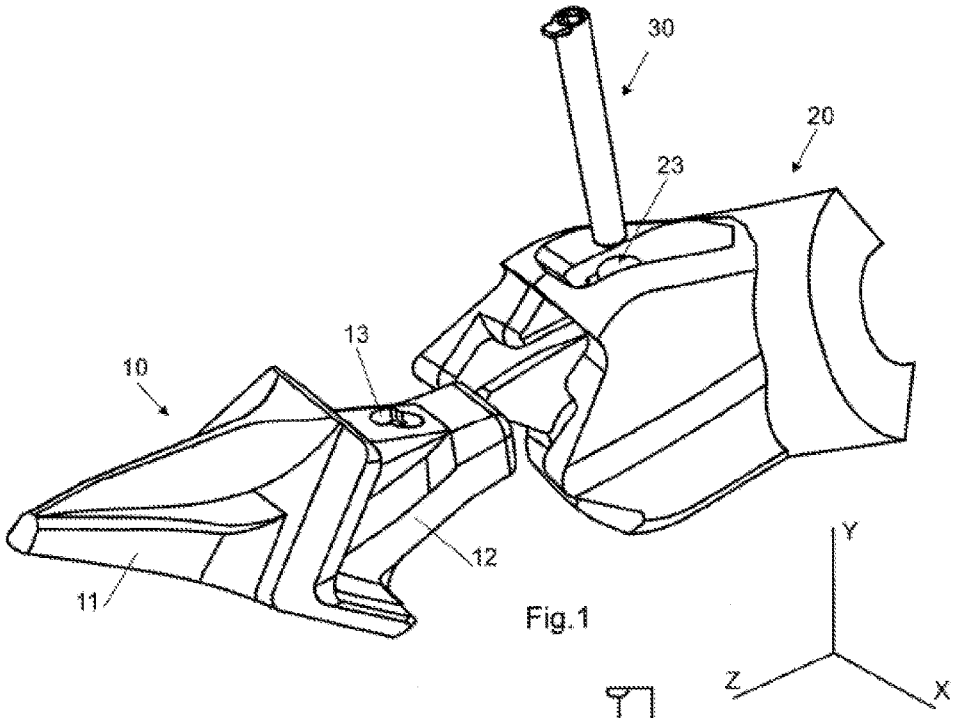
FIG. 1 shows a perspective view of a tooth and an adaptor prior to their coupling.
Figure 2:
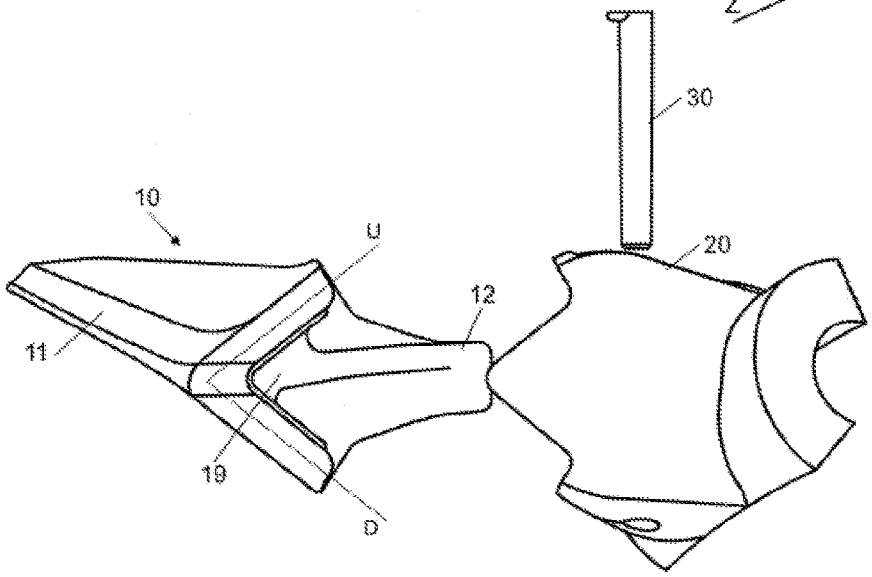
FIG. 2 shows a side view of a tooth and an adaptor prior to their coupling.
Figure 3:
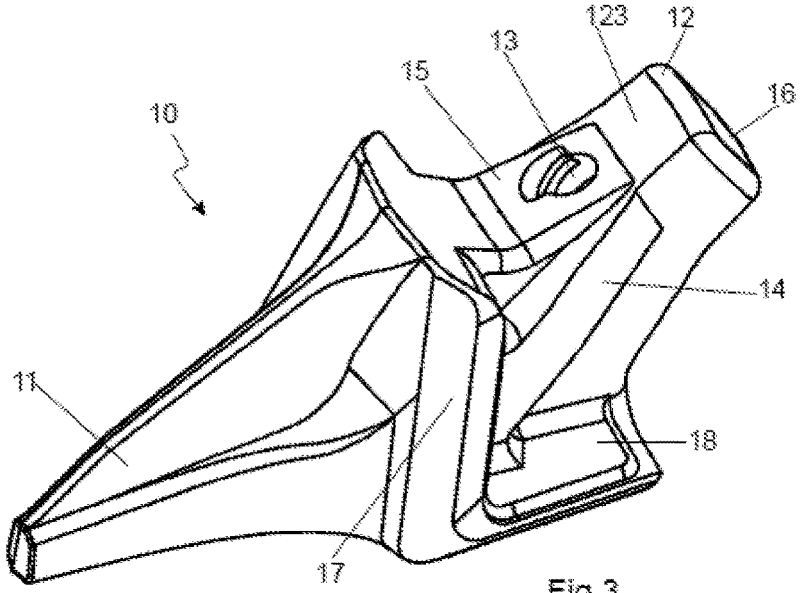
FIG. 3 shows a perspective view of a tooth.
Figure 4:
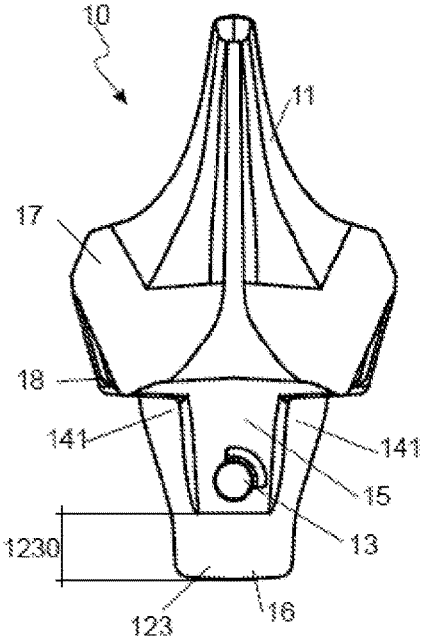
FIG. 4 shows a plan view of a tooth.
Figure 5:
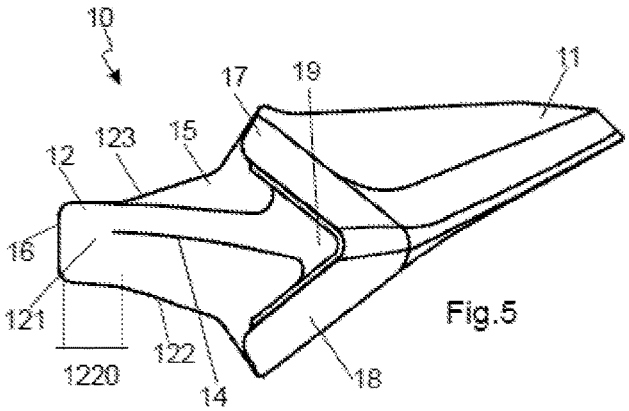
FIG. 5 shows a side view of a tooth.
Figure 6:
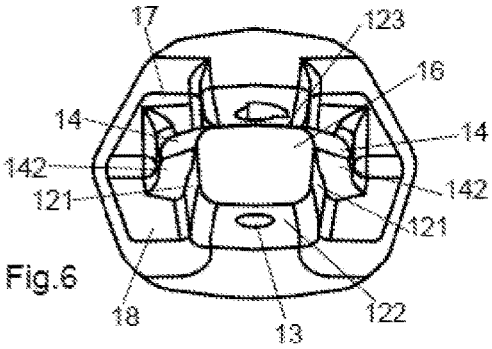
FIG. 6 shows a front view of a tooth.

As observed in FIGS. 1 and 2, the objects of the present application, tooth and adaptor for dredging, is formed by an interchangeable tooth 10, an adaptor 20 coupled to an arm of a cutter head (not shown) of a dredging machine, and a retaining member 30 responsible for assuring the connection between the tooth and the adaptor. Said retaining member or pin 30 enters the adaptor 20 through a hole 23 and enters the tooth through a hole 13. The pin 30 goes through the tooth 10 and the adaptor 20 and is placed in a housing.

As can be observed in FIGS. 3 to 8, the tooth 10 comprises a front wear part 11 or tip of the tooth responsible for the task of tearing out the terrain, in contact with the ground and stones, and a rear coupling part or nose 12 intended for being housed in a cavity 29 arranged in an adaptor 20.

The rear coupling part 12 of the tooth 10 comprises a rear free end 16 and a forward end 19, being this forward end 19 bounded to the front wear part 11 of the tooth 10. The rear coupling part 12 has a first upper surface 123, a first lower surface 122 and two side surfaces 121 joining both upper 123 and lower 122 surfaces. Said first upper surface 123 and said first lower surface 122 comprise each at least a segment 1230, 1220 on its surface 123, 122 where both segments 1230, 1220 are approximately parallel between them. Said approximately parallel segments 1230, 1220, an upper segment 1230 on the first upper surface 123 and a lower segment 1220 on the first lower surface 122, are preferably placed adjacent to the free end 16 of the rear coupling part 12.

The nose or rear coupling part 12 of the tooth 10 is formed by a main body and an upper rib 15 centered on the upper surface 123 of said main body, increasing the section of the rear coupling part 12 where the hole 13 for the pin 30 goes through the nose 12, and being the part of the tooth that more efforts has to resist. Said rib 15 extends between a point from the upper surface 123 of the main body of the rear coupling part 12 and the place where said part 12 binds the front wear part 11. The separation between the front wear part 11 and the rear coupling part 12 is determined by two inclined planes U, D, forming an angle smaller than 90° between both and therefore determining a V shape, where the corner of the V is placed towards the tip front wear part 11 of the tooth 10, on the opposite side of the free end 16 of the rear coupling part or nose 12.

According to the previous definition of the axis x, y and z, it should be mentioned that inclined planes U and D cross themselves in axis x.

As previously explained, the upper rib 15 of the nose 12 of the tooth 10 has a shape that increases the section of the nose 12 towards the forward end 19, having the upper rib 15 a triangular or trapezoidal longitudinal section, preferably. The rib 15 will not extend along the whole distance of the nose 12 of the tooth 10, it will be shorter. The rib 15 can be narrower, smaller width, or have the same width, than the first upper surface 123 of the first main body of the nose 12 and it is centered with respect to said main body 12. The height of said rib 15 is nil in an area close to the free end 16 of the nose 12, preferably when the upper segment 1230 adjacent to the free end starts, and its height gradually increases until it reaches the wear part of the tooth 11.

On both side surfaces 121 of the main body 12, continuous side projections 14 are placed. Said projections 14 have a second upper surface 141 and a second lower surface 142 that are approximately parallel between them. The purpose of these projections 14 is help to optimize the complete stabilization of the coupling between the tooth 10 when coupled to an adaptor 20 when the same is subjected to Inverse forces. These projections 14 have its second upper surfaces 141 parallel to the lower segment 1220 on the first lower surface 122 of the main body 12 approximately and its second lower surfaces 142 approximately parallel to the upper segment on the first upper surface 1230 of the main body 12. The thickness or distance between the second upper 141 and lower 142 surfaces of the projections 14 is smaller than the distance between the upper segment 1230 of the first upper surface 123 of the main body 12 and the lower segment 1220 of the first lower surface 122 of the main body 12.

The second upper surfaces 141 of the projections 14 are preferably placed as an extension of the first upper surface 123 of the main body 12, meaning that the second upper surface 141 of the projection 14 and the first upper surface 123 of the main body 12 are placed at the same level. Anyway, instead of coinciding the upper surfaces 141 of the projections 14 with the upper surfaces 123 of the main body 12, it would be possible that the second lower surfaces 142 do coincide with the lower surface 122 of the main body 12, or even that none of the upper nor lower surfaces coincide, being in this last case the side projections 14 placed between the first upper 123 and lower 122 surfaces of the main body 12.

In the present description, when the term approximately parallel is used, it should be understood that the lines, planes or surfaces referred, could not be exactly parallel but a difference between 0° and 8° could exist between them. This difference will mainly be due to construction or fabrication restrictions that prevent the exact parallelism between the lines, planes or surfaces.

The tooth preferably comprises a stopper, with the shape of a collar, flange or perimeter projection, located on the perimeter of the tooth 10 where the front wear part 11 and the rear coupling part 12 bind. The stopper has two V-shaped sides on both sides of the tooth 10, each with a superior part 17 and a lower part 18, that coincide with the inclination of the previously mentioned planes U and D. The width between the V-shaped sides 17, 18 of the stopper is preferably larger than the distance between the sides of the projections 14 and the height or distance between the upper and lower sides of said stopper coincides with the maximum distance between the upper surface of the upper rib 15 on the main body 12 and the lower surface 122 of the main body 12. The thickness or width of said collar varies depending on the area of the tooth it surrounds and depending on the stresses to which said area is subjected.

FIG. 8*a* shows a section of the tooth 10 at the segment (1220 o 1230) of the nose 12, FIG. 8*b* shows a section of the tooth 10 at the hole 13 for the pin 30, and FIG. 8*c* shows a section of the tooth 10 showing the side projections 14 on the side surfaces 121 of the nose 12.

The adaptor 20, shown in FIGS. 9 to 11 is formed by a body having a rear coupling 200 at one end to be attached to an arm of the cutter head of a dredging machine and at the opposite end it has an open end 210 with a cavity 29 for receiving the rear coupling part or nose 12 of a tooth 10, which is inserted in said cavity 29. The inner surfaces, of said cavity 29 of the adaptor 20 are complementary to the surfaces of the rear coupling part or nose 12 of the tooth 10. In other words, said cavity 29 is formed by an open end 210, a bottom end 26 opposite to the previous one and bounded to the rear coupling end 200, a first lower surface 222, a first upper surface 223, and two side surfaces 221 joining both upper 223 and lower 222 surfaces. The shape of said open end 210 of the cavity 29 is defined by the shape of the two side surfaces 221 belonging to the lateral or side walls of the adaptor 20, which have an V shape with a superior part 27 and a lower part 28. Said V shape coincide with the two inclined planes U and D.

As previously described, the inner surfaces of the cavity 29 are complementary to the surfaces of the rear coupling part or nose 12 of the tooth 10.

Each of the side surfaces 221 of the cavity 29 comprises a groove 24 that extends from the open end 210 of the cavity 29 to nearly the first segment 2220, 2230 of the cavity 29, being the second upper surface 242 of the groove 24 parallel to the first segment 2220 of the first lower surface 222 of the cavity 29 and the second lower surface 241 of the groove 24 parallel to the first segment 2230 of the first upper surface 223 of the cavity 29. The distance between the second upper 242 and lower 241 surfaces of the grooves 24 is smaller than the distance between the first upper 2230 and lower 2220 segments of the cavity 29. The second upper surface 242 of the groove 24 is preferably an extension of the first upper surface 223 of the cavity 29. Anyway the grooves 24 could be placed at any level of the side surfaces 221.

As shown in FIGS. 12 to 16, the tooth 10 and adaptor 20 are coupled together by inserting the rear coupling part or nose 12 of the tooth 10 into the cavity 29 of the adaptor 20, the different complementary surfaces of the nose 12 and of the cavity 29 coming into contact with one another.

In FIGS. 13*a* to 13*c*, the matching of the different contact surfaces along the rear coupling part or nose 12 of the tooth 10 and the cavity 29 of the adaptor 20 can be seen. FIG. 13*a* shows a section where it can be seen the coupling between the projections 14, with its upper 141 and lower 142 surfaces, and the grooves 24, with its upper 242 and lower 241 surfaces.

FIG. 13*b* shows a section of the assembly where the pin goes through both members.

FIG. 13*c* shows the section near to the free end 16 of the nose 12, where the first segment 1230, 1220 of the first upper 123 and lower 122 surfaces of the nose 12 of the tooth 10 are parallel with the first segment 2230, 2220 of the first upper 223 and lower 222 surfaces of the cavity 29 of the adaptor 20. The side surfaces 121 of the nose 12 are parallel to the side surfaces 221 of the cavity 29.

FIGS. 15 and 16 show different longitudinal sections of the coupling between a tooth 10 and an adaptor 20 according to the present invention. In particular it can be seen the different contact surfaces between both members and in FIG. 16 it can be seen that the second upper surface 141 of the projection 14 is at the same level of the first segment 1230 of the first upper surface 123 of the nose 12 of the tooth. The same happens with the complementary surfaces of the groove and the segment 2230 of the upper surface 223 of the cavity 29.

Once the adaptor 20 has been attached through its rear coupling end 200 in the arm of the cutter head of the suction cutting dredger, the tooth 10 is coupled to the adaptor using for that purpose a preferably hammerless retaining member 30, i.e. a member that does not require the action of a mallet or hammer for removing it from or inserting it in the housings intended for such purpose in the tooth and in the adaptor. The retaining system is preferably vertical, being inserted and removed through the upper part of the tooth and of the adaptor, going through the rear coupling part or nose 12 of the tooth 10 and the adaptor 20 through respective through holes 13, 23.

Once the assembly is coupled, as previously describe, and during the working operations, the tooth 10 is subjected at its tip to different forces. Said forces make that reactions forces with orthogonal components appear on said tip:

Normal force or radial force: in a same direction of the imaginary line between the center line of the cutter head and the point of the tooth, applied on a normal surface.

Tangential force: perpendicular to the normal force and applied on the working surface of the tooth. Parallel to the ground.

Lateral force: Mainly caused by the interaction of neighboring cuts.

As already described, the teeth and adaptors are ready to be stabilized to resist the normal, and tangential forces. The unexpected inverse forces in prior art solutions make some of the components of the assembly move or even break, therefore showing that the assembly is not completely stabilized against all the possible reaction forces.

Once the tooth and the adaptor have been coupled the assembly is ready to work on the cutter head. When the point of the tooth is subjected to tangential forces, the surfaces where reactions are created, to equilibrate said forces, are the first segment on the lower surface of the tooth and the upper surface of the main body of the nose, near the forward end 19 of the main body. With these contact surfaces between the tooth and the adaptor the tangential forces are counteracted to resist the efforts and diminish the strain in critical points of the assembly as well as in the pin.

However, when the unexpected inverse forces appear, usually when working on hard soil, it is necessary to counteract the same and the reactions are translated to the first segment on the upper surface of the nose of the tooth and on the lower surface of the projections (FIG. 19).

Due to the projections on the tooth (and the grooves in the adaptor) placed near the center of both members, the maximum effort that has to be resisted by the coupling is placed in the neutral part of said coupling.

The invention claimed is:

1. An adaptor for attaching a tooth to the arm of a cutter head in a dredging machine, comprising a rear coupling end and a front coupling end, said front coupling end further comprising a main cavity with:

a bottom end and an open end, a first upper surface, a first lower surface, two side surfaces joining the first upper and first lower surfaces, with a distance between the first upper surface and first lower surface decreasing towards the bottom end, side grooves, and an upper segment and a lower segment, wherein:

each side surface of the main cavity comprises a respective one of the side grooves with a second upper surface parallel to a second lower surface, and said second upper surface of each side groove is approximately parallel to the lower segment adjacent to the bottom end on the first lower surface and the second lower surface of each side groove is approximately parallel to the upper segment adjacent to the bottom end on the first upper surface, and a distance between the second upper surface and the second lower surface of each groove is smaller than a distance between the upper segment and the lower segment of the main cavity.

2. The adaptor in accordance with claim 1, wherein the second upper surface is at a same level as the upper segment of the first upper surface of the cavity.

3. The adaptor in accordance with claim 1, wherein side walls of the cavity comprise V-shaped sides.

* * * * *